US010280035B2

(12) United States Patent
Zheng

(10) Patent No.: US 10,280,035 B2
(45) Date of Patent: May 7, 2019

(54) KIND OF POWER PAYING-OFF CRADLE AND POWER PAYING-OFF FULL-AUTOMATIC STRANDING CABLE MACHINE

(71) Applicant: Dongguan City Qingfeng Electrical Machinery Co., Ltd., Guangdong (CN)

(72) Inventor: Qingjun Zheng, Guangdong, CA (US)

( * ) Notice: Subject to any disclaimer, the term of this patent is extended or adjusted under 35 U.S.C. 154(b) by 217 days.

(21) Appl. No.: 15/603,477

(22) Filed: May 24, 2017

(65) Prior Publication Data

US 2018/0294077 A1 Oct. 11, 2018

(30) Foreign Application Priority Data

Apr. 7, 2017 (CN) ..... 2017 1 0225358

(51) Int. Cl.
*B65H 59/08* (2006.01)
*D07B 3/00* (2006.01)
(Continued)

(52) U.S. Cl.
CPC ..... *B65H 59/08* (2013.01); *B65H 59/36* (2013.01); *B65H 59/387* (2013.01); *D07B 3/00* (2013.01);
(Continued)

(58) Field of Classification Search
CPC ..... B65H 59/00; B65H 59/08; B65H 59/10; B65H 59/36; B65H 59/381–387; B65H 2701/34; B65H 2701/00; B65H 2701/30–36; B65H 2701/341; D07B 3/00–10; D07B 7/00–06; D07B 2207/40; D07B 2207/4004; D07B 2207/4013; D07B 2301/25; D07B 2301/258; D07B 2301/2501; H01B 13/02; H01B 13/0214;
(Continued)

(56) References Cited

U.S. PATENT DOCUMENTS 3,715,877 A * 2/1973 Akachi ..... H01B 13/0228 174/34
3,732,682 A * 5/1973 Crotty ..... H01B 13/02 57/59
(Continued)

FOREIGN PATENT DOCUMENTS

FR 2413310 A1 * 7/1979

*Primary Examiner* — Ismael Izaguirre
(74) *Attorney, Agent, or Firm* — Prakash Nama; Global IP Services, PLLC

(57) ABSTRACT

A power paying-off cradle consisting of power paying-off component and framework. In the framework is a cavity with an upper opening; a wire tension balance mechanism is installed in the cavity; a displacement wheel is installed on the wire tension balance mechanism, and a position detector of the displacement wheel is installed on the inner side wall of the framework; a turning wheel is installed on the front top of the framework; a thread hole is installed in the front of the framework; wire on the paying-off spool enwinds the turning wheel and the displacement wheel successively and passes through the thread hole. The wire tension balance mechanism has damping effect on the displacement wheel. When the tension of the displacement wheel is greater than or less than the damping force, the displacement wheel moves in order to ensure consistency of the tension or the strain of wire.

15 Claims, 4 Drawing Sheets

(51) Int. Cl.
*D07B 7/06* (2006.01)
*B65H 59/36* (2006.01)
*B65H 59/38* (2006.01)

(52) U.S. Cl.
CPC ..... *D07B 7/06* (2013.01); *B65H 2701/341* (2013.01); *D07B 2207/4004* (2013.01); *D07B 2301/258* (2013.01); *D07B 2501/406* (2013.01)

(58) Field of Classification Search
CPC ..... H01B 13/0221; H01B 13/0228; H01B 13/0235; H01B 13/0257
See application file for complete search history.

(56) References Cited

U.S. PATENT DOCUMENTS 4,098,063 A * 7/1978 Varga ..... D07B 3/06 57/13
4,291,527 A * 9/1981 Allard ..... D07B 7/00 57/294
4,423,588 A * 1/1984 Garcia ..... B65H 57/28 242/156.2
4,473,995 A * 10/1984 Gentry ..... D07B 3/10 57/215
4,530,471 A * 7/1985 Inoue ..... B23H 7/10 219/69.12
4,789,813 A * 12/1988 Orchard ..... B65H 59/387 242/414.1
5,263,309 A * 11/1993 Campbell ..... D07B 3/06 57/13
5,282,353 A * 2/1994 Kellstrom, Jr. ..... D07B 7/04 476/36
5,390,482 A * 2/1995 Ito ..... B65H 51/30 226/44
6,152,396 A * 11/2000 Rapila ..... B65H 59/36 242/420.6
2001/0033727 A1* 10/2001 Roba ..... B65H 59/385 385/134

* cited by examiner

KIND OF POWER PAYING-OFF CRADLE AND POWER PAYING-OFF FULL-AUTOMATIC STRANDING CABLE MACHINE

BACKGROUND OF THE INVENTION

This invention relates to the manufacture of electric wire, more particular, a kind of power paying-off cradle and power paying-off full-automatic stranding cable machine.

Power paying-off full-automatic stranding cable machine is mainly applied to high-end cable stranding. Presently, automatic tension stranding machine exerts tension on the paying-off spool using magnetic tensioner or rope friction damper, calculates and controls the paying-off tension (tension) through PLC. It aims to keep the paying-off tension constant indirectly and cables of the paying-off spool are different in the middle and at both ends, so passive tension structure cannot solve this problem now. In view of the above defects, it is very necessary to design a kind of power paying-off cradle and power paying-off full-automatic stranding cable machine.

BRIEF SUMMARY OF THE INVENTION

This invention is intended to solve the following technical problem: provide a kind of power paying-off cradle and power paying-off full-automatic stranding cable machine in order to solve the problem that existing stranding machines cannot keep the paying-off tension or the tension constant.

To solve the above problem, the technical proposal of this invention is that: a kind of power paying-off cradle of power paying-off full-automatic stranding cable machine consists of the power paying-off component and the framework. In the framework is a cavity with an upper opening; a wire tension balance mechanism is installed in the cavity; a displacement wheel is installed on the wire tension balance mechanism and a turning wheel is installed in the upper front of the framework; a thread hole is installed in the front of the framework; the paying-off spool is installed in the power paying-off component; wire on the paying-off spool enwinds the turning wheel and the displacement wheel successively and passes through the thread hole. When the tension of the wire is greater than or less than the damping force of the wire tension balance mechanism, the displacement wheel moves in the traction direction of the stranded wire or in the opposite direction in order to keep the wire tension constant.

A position detector of the displacement wheel is installed on the inner side wall of the framework. When the detector detects changes in the position of the displacement wheel, the speed of the power paying-off component is controlled.

The power paying-off component consists of the fixing frame on an end of the framework and paying-off motor and the locking tip on both sides of the fixing frame respectively; the locking tip compacts the paying-off spool on the main shaft of the paying-off motor.

The wire tension balance mechanism is a thrust motor; the displacement wheel is installed on the mounting plate of the thrust motor.

The wire tension balance mechanism consists of the guide rail in the cavity, the sliding block on the guide rail and the spring or the air spring with buffer effect on the sliding block.

The turning wheel consists of the fixing frame on the framework and the guide wheel on the fixing frame; outlet spool is a hollow shaft in the thread whole.

The detector is a range sensor.

Compared with existing technologies, the power paying-off cradle consists of the power paying-off component and the framework. In the framework is a cavity with an upper opening; a wire tension balance mechanism is installed in the cavity; a displacement wheel is installed on the wire tension balance mechanism and a position detector of the displacement wheel is installed on the inner side wall of the framework; a turning wheel is installed on the front end of the framework; a thread hole is installed in front of the framework; the paying-off spool is installed in the power paying-off component, wire on the paying-off spool enwinds the turning wheel and the displacement wheel successively and passes through the thread hole; the traction mechanism drives movement of the wire during stranding. When the tension of the wire increases, the tension on the displacement wheel is greater than the damping force of the wire tension balance mechanism and the displacement wheel moves to the stressed side. Thus, the tension on the displacement wheel can be released. When the tension on the displacement wheel decreases, the wire tension balance mechanism drives the displacement wheel to move in the opposite direction in order to tension the wire and keep the tension consistent.

A kind of power paying-off full-automatic stranding cable machine consists of the power paying-off cradle and the base. The main supporting seat and the assistant supporting seat are installed on both ends of the base; two ends of the main shaft pass through the main supporting seat and the assistant supporting seat respectively; the main shaft is connected to the main supporting seat and the assistant supporting seat; there is at least one set of paying-off mechanism on the main shaft; the paying-off component consists of two installing disks on the main shaft and at least two power paying-off cradles between two installing disks; a drive mechanism which drives the main shaft to rotate is installed on the base; and a distributing terminal board is installed on the end of the main shaft.

Many power paying-off cradles are distributed around the main shaft. Along the delivery direction of stranded wire, the rear end of the power paying-off cradle in the paying-off mechanism in the last group and the front end of the power paying-off cradle in the paying-off mechanism in the next group share the installing disk.

When the drive mechanism drives the main shaft and the installing disk to rotate, it drives the power paying-off cradle in the paying-off mechanism adjacent to the main supporting seat to rotate in the direction of stranded wire; and the rotating power paying-off cradle drives that in the adjacent paying-off mechanism to rotate.

Two ends of the power paying-off cradle pass through two installing disks respectively; the drive mechanism consists of the sun gear on the main supporting seat and the transmission gear at the end of the power paying-off cradle; the axis of the sun gear coincides with that of the main shaft; when the main shaft rotates, the sun gear drives the transmission gear engaged in the sun gear to rotate, or the sun gear and the transition gear, which is installed at the end of the installing disk and is engaged in the sun gear and the transmission gear, drive the power paying-off cradle to rotate.

A secondary transmission gear is installed on the other end of the power paying-off cradle; a secondary transition gear is installed between the secondary transmission gear and the transmission gear of the power paying-off cradle in the adjacent paying-off mechanism; and the secondary transition gear is installed on the installing disk.

An electrical over slide ring is installed on the end of the main shaft and on the end of the power paying-off cradle.

The installing disk is a circular disk; and a brake matching with the installing disk adjacent to the main supporting seat is installed on the base.

An over-line wheel is installed outside the thread hole on the installing disk.

Compared with existing technologies, the power paying-off full-automatic stranding cable machine consists of the power paying-off cradle and the base. The main supporting seat and the assistant supporting seat are installed on both ends of the base; two ends of the main shaft pass through the main and the assistant supporting seats respectively; the main shaft rotates and is connected to the main and the assistant supporting seats; there is at least a set of paying-off mechanism on the main shaft; the paying-off component consists of two installing disks on the main shaft and at least two power paying-off cradles between the two installing disks; a main shaft drive mechanism is installed on the base; and a distributing terminal board is installed at the end of the main shaft. The paying-off spool is placed in the power paying-off cradle during stranding and wire in the paying-off spool passes through the thread hole in the distributing terminal board and then it is connected to the traction mechanism; the drive mechanism drives the main shaft to rotate and thus the axis of the main shaft of the power paying-off cradle is driven to rotate and wire stranding is realized; the power paying-off cradle keeps the wire tension consistent in the stranding process.

DETAILED DESCRIPTION OF THE INVENTION

Based on the above accompanying drawings, mode of execution will be further described as below:

Details are described below in order to give a full understanding of the basic concept of the cases. Obviously, technical personnel of this field can practice the cases with such details fully or partially described. Processing steps were not described in detail in other cases.

Figure 1:
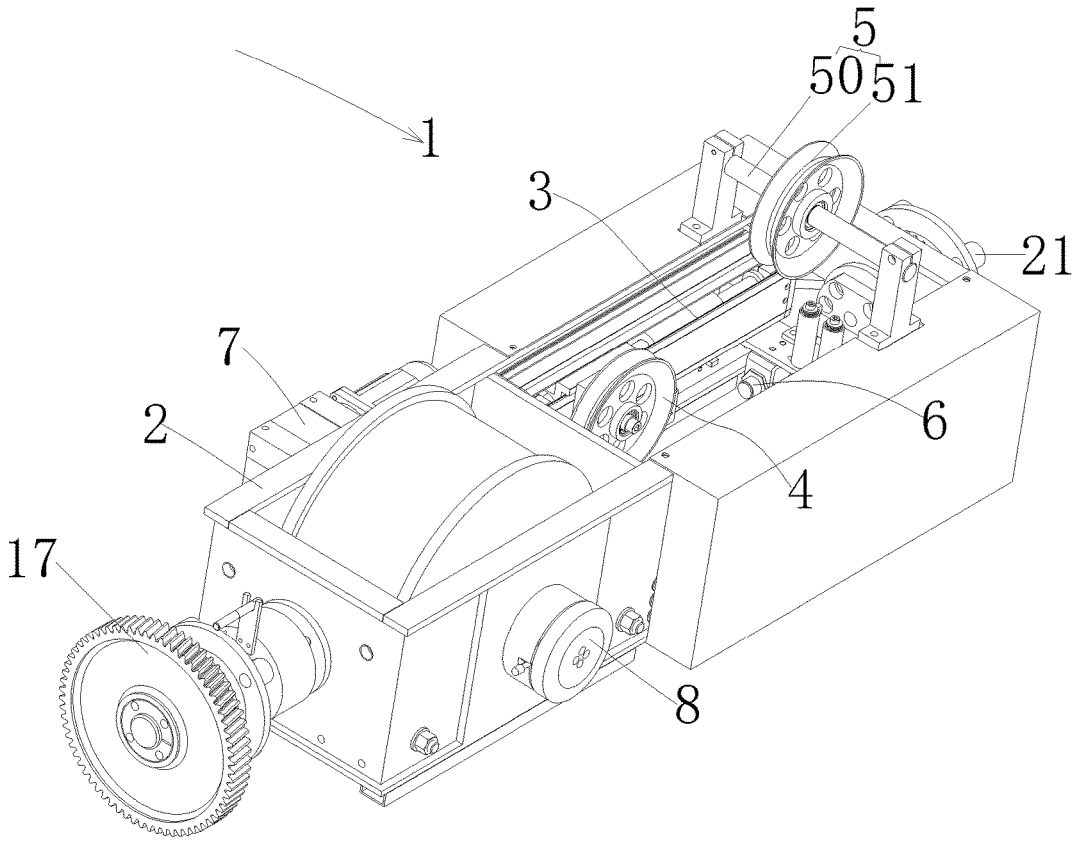
FIG. 1 is the stereo view of the power paying-off cradle of this invention.
Figure 2:
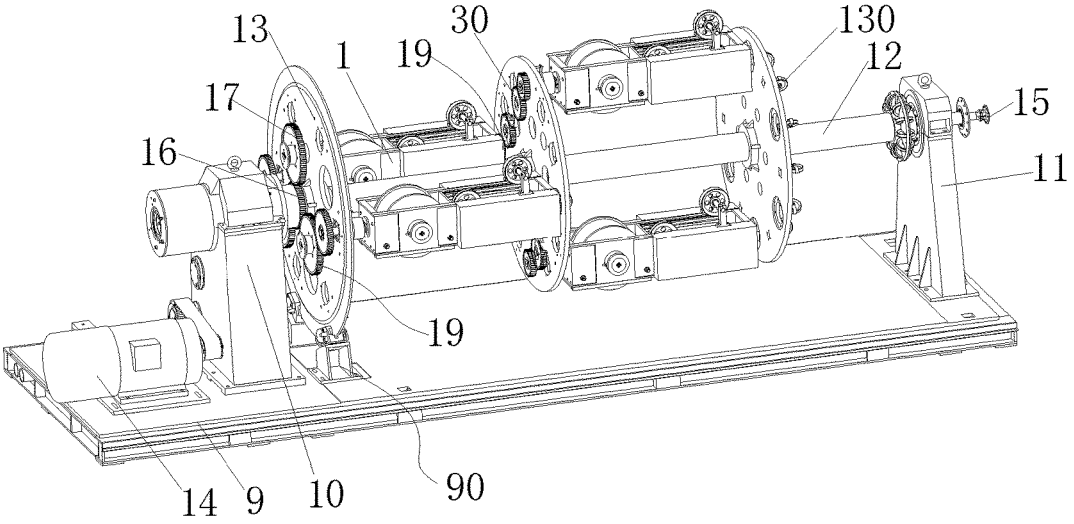
FIG. 2 is the stereo view of the power paying-off full-automatic stranding cable machine of this invention.
Figure 3:
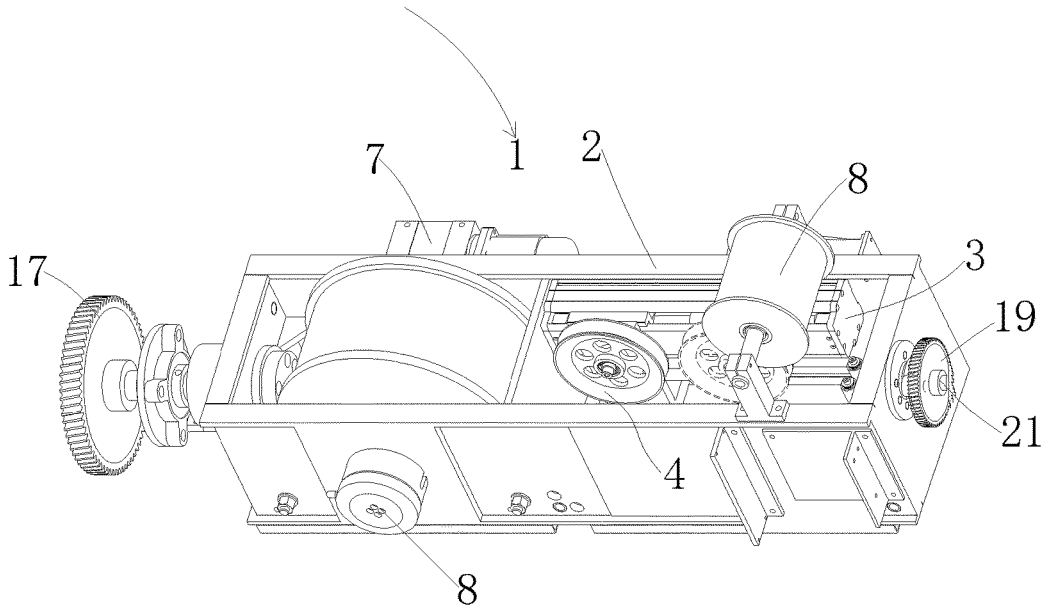
FIG. 3 is the stereo view of the power paying-off cradle of the power paying-off full-automatic stranding cable machine of this invention.
Figure 4:
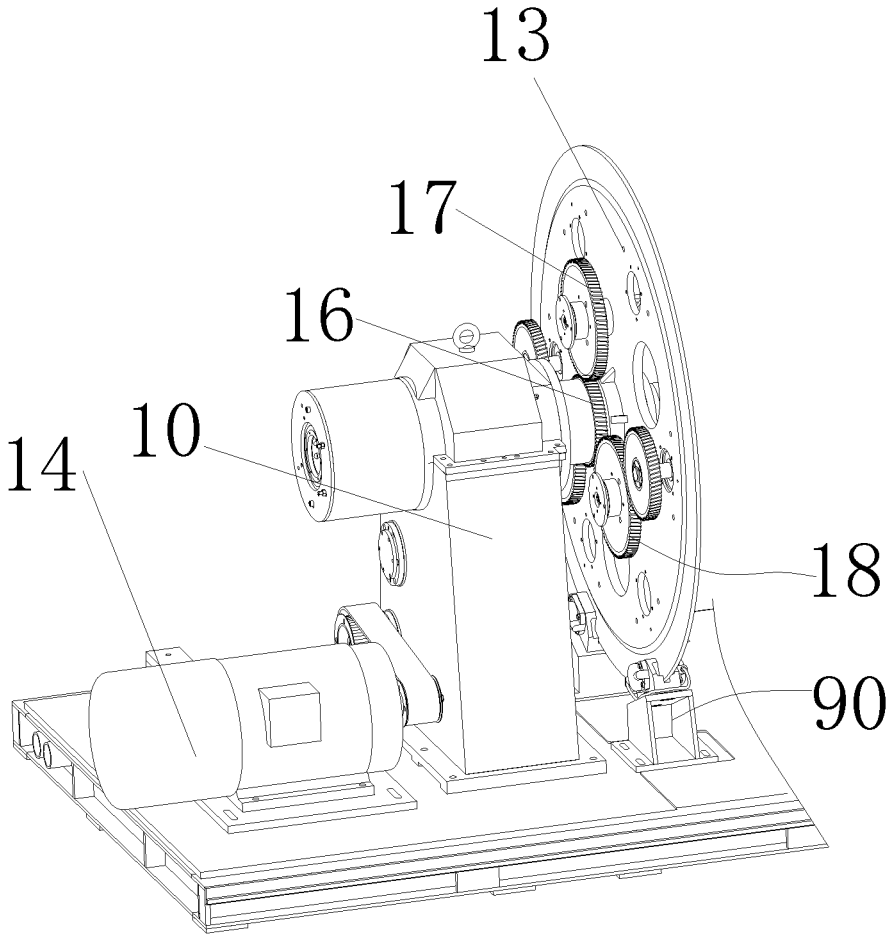
FIG. 4 is the partial enlarged view of the power paying-off full-automatic stranding cable machine of this invention.

As shown in FIG. 1, power paying-off cradle 1 consists of the power paying-off component and framework 2. In framework 2 is a cavity with an upper opening; wire tension balance mechanism 3 is installed in the cavity; displacement wheel 4 is installed in on wire tension balance mechanism 3 and turning wheel 5 is installed on the front top of framework 2; a thread hole is installed in front of framework 2; the paying-off spool is installed in the power paying-off component and wire on the paying-off spool enwinds turning wheel 5 and displacement wheel 4 successively and passes through the thread hole; the traction mechanism drives movement of the wire during stranding. When the tension of the wire increases, the tension on displacement wheel 4 is greater than the damping force of wire tension balance mechanism 3 and displacement wheel 4 moves to the stressed side. Thus, the tension on displacement wheel 4 can be released in order to control the stress on displacement wheel 4. When displacement wheel 4 moves and the tension on it decreases, wire tension balance mechanism 3 drives displacement wheel 4 to move in the opposite direction in order to tension the wire and keep the tension consistent.

Position detector 6 of the displacement wheel is installed in framework 2; when detector 6 detects changes in the position of displacement wheel 4, the speed of the power paying-off component is controlled. When detector 6 detects that displacement wheel 4 moves in the delivery direction of stranded wire, it will give feedback to the control system and the power paying-off component will accelerate, and wire tension balance mechanism drives displacement wheel 4 to the original position. When detector 6 detects that displacement wheel 4 in the opposite direction, it gives feedback to the control system in order to control the speed of the power paying-off component, drive displacement wheel to the original position and ensure the tension of the wire.

The power paying-off component consists of the fixing frame on the framework and paying-off motor 7 and locking tip 8 on both sides of the fixing frame; locking tip 8 compacts the paying-off spool on the main shaft of paying-off motor 7.

Wire tension balance mechanism 3 is a thrust motor; displacement wheel 4 is installed on the mounting plate of the thrust motor. Thus, the thrust motor has damping effect and reset effect on displacement wheel 4.

Wire tension balance mechanism 4 consists of the guide rail in the cavity, the sliding block on the guide rail and the spring or the air spring with buffer effect on the sliding block. Displacement wheel 4 is installed on the sliding block; so the spring or the air spring has damping effect and reset effect on displacement wheel 4.

Turning wheel 5 consists of fixing frame 50 on the top of framework 2 and guide wheel 51 on fixing frame 50; outlet shaft 21 is installed in the thread hole; outlet shaft 21 is a hollow shaft. So the guide wheel passes through outlet shaft 21 during stranding.

Detector 6 is a range sensor. Thus, it detects the position of the guide wheel and gives feedback to the control system; the control system controls the rotate speed of paying-off motor 3.

A kind of power paying-off full-automatic stranding cable machine consists of power paying-off cradle 1 and base 9. Main supporting seat 10 and assistant supporting seat 11 are installed on both ends of base 9; two ends of main shaft 12 pass through main supporting seat 10 and assistant supporting seat 11; main shaft 11 rotates and is connected to main supporting seat 10 and assistant supporting seat 11; there is at least a paying-off mechanism on main shaft 12; the paying-off component consists of two installing disks 13 on main shaft 12 and at least two power paying-off cradle 1 between the two installing disks 13; drive mechanism 14 which drives main shaft 12 to rotate is installed on base 9; distributing terminal board 15 is installed on the end of main shaft 12. During stranding, the paying-off spool is placed in power paying-off cradle 1 and wire in the paying-off spool passes through the hole in distributing terminal board 15 and is connected to the traction mechanism; drive mechanism 14 drives main shaft 11 to rotate and thus the axis of main shaft 12 of power paying-off cradle 1 is driven to rotate and wire stranding is realized; power paying-off cradle 1 keeps the wire tension consistent in the stranding process. Of which the drive mechanism is a motor and a synchronous belt drive mechanism.

Many power paying-off cradles 1 are distributed around main shaft 12. Along the delivery direction of stranded wire, the rear end of power paying-off cradle 1 in the paying-off mechanism in the last group and the front end of power paying-off cradle 1 in the paying-off mechanism in the next group share installing disk 13.

When drive mechanism 14 drives main shaft 12 and installing disk 13 to rotate, it drives power paying-off cradle 1 in the paying-off mechanism adjacent to main supporting seat 10 to rotate in the direction of stranded wire; and rotating power paying-off cradle 1 drives that in the adjacent paying-off mechanism to rotate. Thus, the wire will be twisted by stranding force and rotation of power paying-off cradle 1 can avoid deformation of the wire arising from the twisting force; and consequently the quality of cable stranding is guaranteed.

Two ends of power paying-off cradle 1 pass through two installing disks respectively; the drive mechanism consists of sun gear 16 on main supporting seat 10 and transmission gear 17 at the end of power paying-off cradle 1; the axis of sun gear 16 coincides with that of main shaft 12; when main shaft 12 rotates, sun gear 16 drives transmission gear 17 engaged in sun gear 16 to rotate, or sun gear 16 and transition gear 18, which is installed at the end of installing disk 13 and is engaged in sun gear 16 and transmission gear 17, drive power paying-off cradle 1 to rotate. Thus, when installing disk 13 rotates, transmission gear 17 revolves around sun gear 16 and it drives transmission gear 17 to rotate, and consequently power paying-off cradle 1 is driven to rotate; or transition gear 18 revolves around sun gear 16 and drives power paying-off cradle 1 to rotate.

Secondary transmission gear 19 is installed on the other end of power paying-off cradle 1; secondary transition gear 30 is installed between secondary transmission gear 19 and transmission gear 17 of power paying-off cradle 1 in the adjacent paying-off mechanism; and secondary transition gear 30 is installed on installing disk 13. Thus, when power paying-off cradle 1 of the last group rotates, secondary transmission gear 19 drives secondary transition gear 30 to rotate and drives power paying-off cradle 1 of the next group to rotate in the direction of stranded wire.

Electrical over slide ring is installed on the end of the main shaft and on the end of the power paying-off cradle. Installing disks 13 is a circular disk; brake 90 matching with installing disk 13 adjacent to main supporting seat 10 is installed on base 1. Thus, brake 90 has quick braking effect after stranding. Brake 90 is a pneumatic brake.

Over-line guide wheel 130 is installed outside the thread hole on installing disk 13. Over-line guide wheel 130 can guide the wire.

This invention is not confined to the above modes of execution. Based on the above modes of execution; all transformations made by technical personnel of this field without creative work shall be vested in the protection scope of this invention.

What is claimed is:

1. A kind of power paying-off cradle of power paying-off full-automatic stranding cable machine containing power paying-off component, which is characterized in that: it also contains a framework, In the framework is a cavity with an upper opening; a wire tension balance mechanism is installed in the cavity; a displacement wheel is installed on the wire tension balance mechanism and a turning wheel is installed on the front top of the framework; a thread hole is installed in the front of the framework; the paying-off spool is installed in the power paying-off component, and wire on the paying-off spool enwinds the turning wheel and passes through the thread hole successively; during wire stranding, the traction is greater than or less than the damping force of the wire tension balance mechanism, the displacement wheel moves along the stranded wire traction direction or in the opposite direction, and consequently the tension remains constant.

2. The power paying-off cradle mentioned in claim 1 is characterized in that: a position detector of displacement wheel is installed on the inner side wall of the framework; when the detector detects changes in the position of the displacement wheel, the sped of the power paying-off component is controlled.

3. The power paying-off cradle mentioned in claim 1 is characterized in that: the power paying-off component consists of the fixing frame on one end of the framework and the paying-off motor and the locking tip on both sides of the fixing frame; the locking tip compacts the paying-off spool on the main shaft of the paying-off motor.

4. The power paying-off cradle mentioned in claim 1 is characterized in that: the wire tension balance mechanism is a thrust motor; the displacement wheel is installed on the mounting plate of the thrust motor.

5. The power paying-off cradle mentioned in claim 1 is characterized in that: the wire tension balance mechanism consists of the guide rail in the cavity, the sliding block on the guide rail and the spring or the air spring with buffer effect on the sliding block.

6. The power paying-off cradle mentioned in claim 1 is characterized in that: the turning wheel consists of the fixing frame on the top of the framework and the guide wheel on the fixing frame; outlet spool is a hollow shaft in the thread hole.

7. The power paying-off cradle mentioned in claim 2 is characterized in that: the detector is a range sensor.

8. A kind of power paying-off full-automatic stranding cable machine is characterized in that: it consists of the power paying-off cradle mentioned in claim 1 and the base; the main supporting seat and the assistant supporting seat are installed on both ends of the base; two ends of the main shaft pass through the main and the assistant supporting seats respectively; the main shaft rotates and is connected to the main and the assistant supporting seats; there is at least one set of paying-off mechanism on the main shaft; the paying-off component consists of two installing disks on the main shaft and at least two power paying-off cradles between the two installing disks; a main shaft drive mechanism is installed on the base; and a distributing terminal board is installed at the end of the main shaft.

9. The power paying-off full-automatic stranding cable machine mentioned in claim 8 is characterized in that: many power paying-off cradles are distributed around the main shaft. Along the delivery direction of stranded wire, the rear end of the power paying-off cradle in the paying-off mechanism in the last group and the front end of the power paying-off cradle in the paying-off mechanism in the next group share the installing disk.

10. The power paying-off full-automatic stranding cable machine mentioned in claim 9 is characterized in that: when the drive mechanism drives the main shaft and the installing disk to rotate, it drives the power paying-off cradle in the paying-off mechanism adjacent to the main supporting seat to rotate in the direction of stranded wire; and the rotating power paying-off cradle drives that in the adjacent paying-off mechanism to rotate.

11. The power paying-off full-automatic stranding cable machine mentioned in claim 10 is characterized in that: two ends of the power paying-off cradle pass through two installing disks respectively; the drive mechanism consists of the sun gear on the main supporting seat and the transmission gear at the end of the power paying-off cradle; the axis of the sun gear coincides with that of the main shaft; when the main shaft rotates, the sun gear drives the transmission gear engaged in the sun gear to rotate, or the sun gear and the transition gear, which is installed at the end of the installing disk and is engaged in the sun gear and the transmission gear, drive the power paying-off cradle to rotate.

12. The power paying-off full-automatic stranding cable machine mentioned in claim 11 is characterized in that: a secondary transmission gear is installed on the other end of the power paying-off cradle; a secondary transition gear is installed between the secondary transmission gear and the transmission gear of the power paying-off cradle in the adjacent paying-off mechanism; and the secondary transition gear is installed on the installing disk.

13. The power paying-off full-automatic stranding cable machine mentioned in claim 12 is characterized in that: an electrical over slide ring is installed on the end of the main shaft and on the end of the power paying-off cradle.

14. The power paying-off full-automatic stranding cable machine mentioned in claim 8 is characterized in that: the installing disk is a circular disk; and a brake matching with the installing disk adjacent to the main supporting seat is installed on the base.

15. The power paying-off full-automatic stranding cable machine mentioned in claim 8 is characterized in that: an over-line wheel is installed outside the thread hole on the installing disk.

* * * * *